United States Patent [19]

Niimi et al.

[11] Patent Number: 4,501,242

[45] Date of Patent: Feb. 26, 1985

[54] AIR-FUEL RATIO CONTROL APPARATUS

[75] Inventors: Yukihide Niimi, Kariya; Seietsu Yoshida, Aichi; Hidemi Ohnaka, Susono, all of Japan

[73] Assignees: Nippondenso Co., Ltd., Kariya; Toyota Jidosha Kabushiki Kaisha, Toyota, both of Japan

[21] Appl. No.: 481,232

[22] Filed: Apr. 1, 1983

[30] Foreign Application Priority Data

Apr. 1, 1982 [JP] Japan ..... 57-54223

[51] Int. Cl.[3] ..... F02M 7/12

[52] U.S. Cl. ..... 123/440; 123/589

[58] Field of Search ..... 123/440, 489, 589; 60/276

[56] References Cited

U.S. PATENT DOCUMENTS

| | | | |
|---|---|---|---|
| 3,782,347 | 1/1974 | Schmidt et al. | 123/440 |
| 3,831,564 | 8/1974 | Schmidt et al. | 123/440 |
| 4,361,124 | 11/1982 | Nakamura | 123/440 |
| 4,376,431 | 3/1983 | Yokooku et al. | 123/440 |

*Primary Examiner*—Andrew M. Dolinar

*Attorney, Agent, or Firm*—Cushman, Darby & Cushman

[57] ABSTRACT

In an air-fuel ratio control apparatus for detecting the air-fuel ratio from the oxygen content of the exhaust gas from an engine and feedback controlling the air-fuel ratio at the desired ratio through an integrating circuit, the circuit constant of the integrating circuit is increased with increase in the altitude to improve the control response characteristic.

1 Claim, 3 Drawing Figures

AIR-FUEL RATIO CONTROL APPARATUS

BACKGROUND OF THE INVENTION

The present invention relates to an air-fuel ratio control apparatus for detecting the air-fuel ratio of the mixture from the composition, e.g., the concentration of oxygen in the exhaust gas from an engine and feedback controlling the air-fuel ratio so as to maintain it at the desired ratio.

In a known apparatus of this type including an oxygen concentration detector for detecting the air-fuel ratio, a comparison circuit responsive to the signal from the oxygen concentration detector to make a comparison and determination whether the air-fuel ratio is greater or smaller than a predetermined air-fuel ratio, an integrating circuit responsive to the comparison output to generate an integration voltage and air-fuel ratio control means, e.g., a driver circuit for controlling the amount of air bleed to the carburetor in accordance with the integration voltage as an air-fuel ratio correction amount, the feedback is applied in accordance with a predetermined control constant irrespective of whether a low region or a high region. However, this method is disadvantageous in that the air-fuel ratio becomes richer in the high region than in the low region so that the level of the controlled bleed amount is increased and the bleed sensitivity (a change of the air-fuel ratio in response to a change in the flow rate) is deteriorated thereby deteriorating the control response characteristic.

SUMMARY OF THE INVENTION

With a view to overcoming the foregoing deficiencies in the prior art, it is an object of this invention to provide an air-fuel ratio control apparatus in which a control constant is increased with an increase in the altitude thereby improving the control response characteristic.

DESCRIPTION OF THE PREFERRED EMBODIMENT

An embodiment of the invention will now be described with reference to the accompanying drawings.

Figure 1:
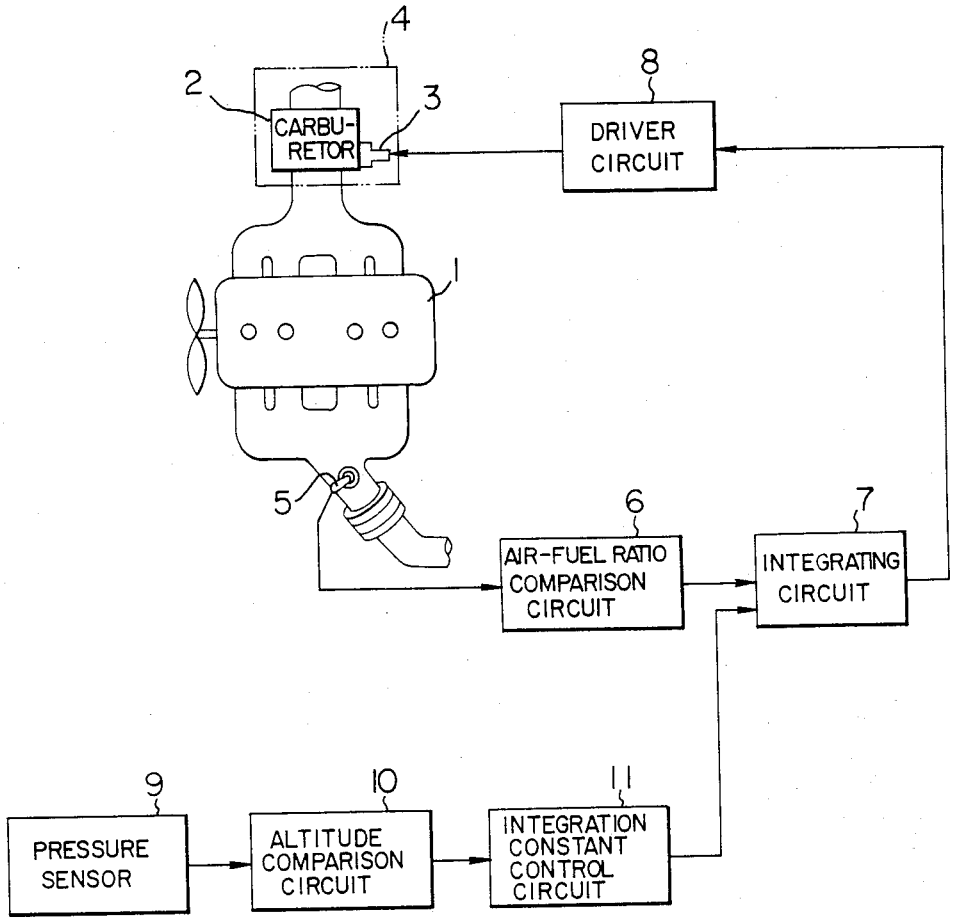
FIG. 1 is a block diagram showing the construction of an air-fuel ratio control apparatus according to the invention.

Referring to FIG. 1 illustrating the overall construction of the embodiment, numeral 1 designates an engine, 2 a carburetor mounted on the intake passage of the engine 1 and including an air-fuel ratio adjusting actuator 3 attached thereto in addition to a throttle valve. The carburetor 2 and the actuator 3 form a fuel metering unit 4 for controlling the air-fuel ratio of the mixture supplied to the engine 1 through the intake passage. The actuator 3 includes a linear solenoid valve for varying the amount of bleed air of the carburetor 2 which is supplied to the intake passage and the opening and closing of this valve are controlled by the current supplied to the actuator 3 thereby adjusting the air-fuel ratio leaner when the valve is opened.

Numeral 5 designates an oxygen concentration detector positioned in the portion where the exhaust manifold branches meets so as to detect the concentration of oxygen in the exhaust gas, 6 an air-fuel ratio comparison circuit for generating an output indicative of the difference between the output of the oxygen concentration detector 5 and a preset value corresponding to a stoichiometric air-fuel ratio, 7 an integrating circuit for generating an integration signal of the difference output from the air-fuel ratio comparison circuit 6, and 8 an actuator driver circuit for controlling the current supplied to the actuator 3 in accordance with the integration voltage from the integrating circuit 7.

Numeral 9 designates a pressure sensor, 10 an altitude comparison circuit for generating an output indicative of the difference between the output of the pressure sensor 9 and a preset value corresponding to a predetermined altitude, and 11 an integration constant control circuit responsive to the output from the altitude comparison circuit 10 to vary the integration constant of the integrating circuit 7 and thereby improve the air-fuel ratio feedback response characteristic.

Figure 2:
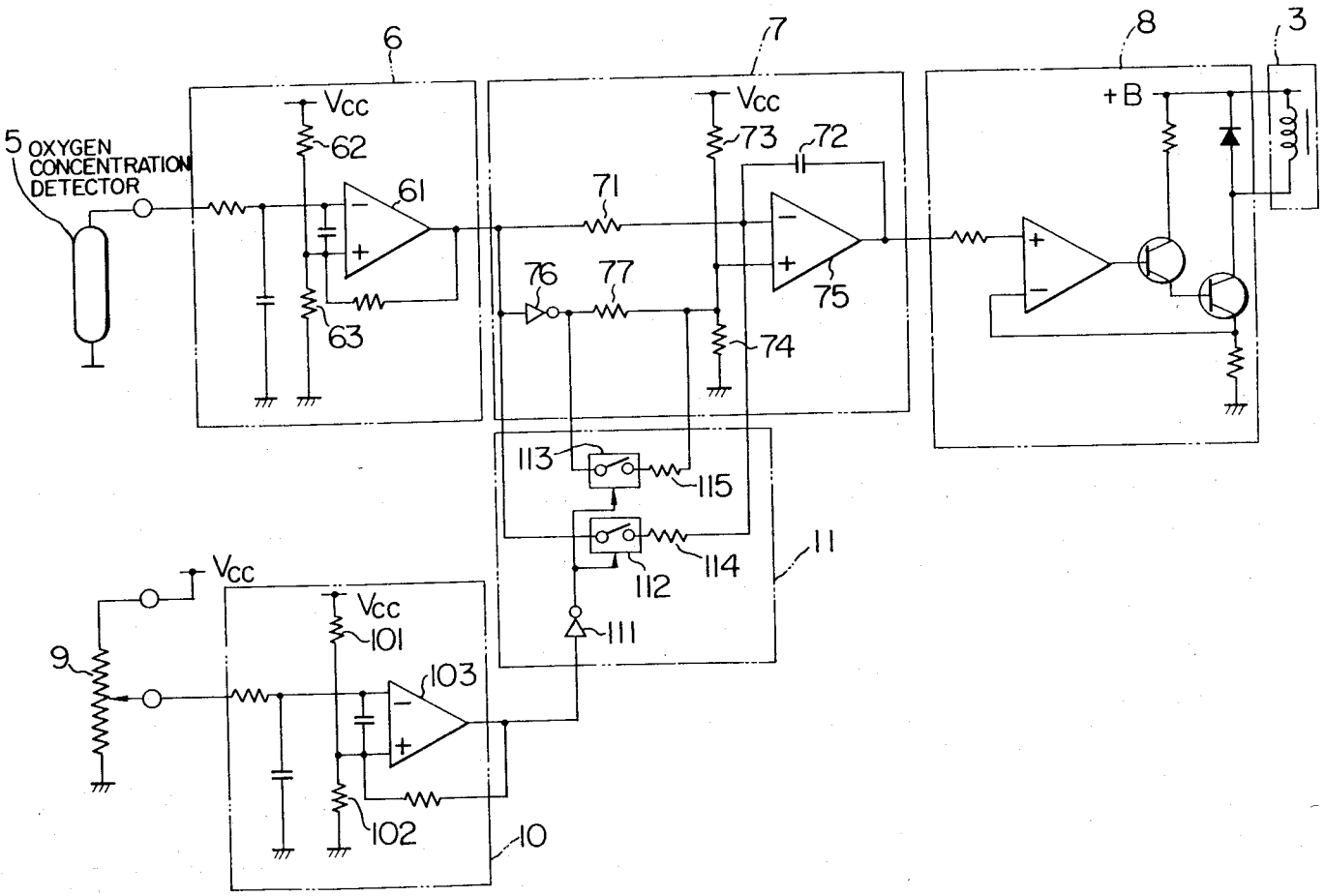
FIG. 2 is a circuit diagram showing the details of the block diagram of FIG. 1.
Figure 3:
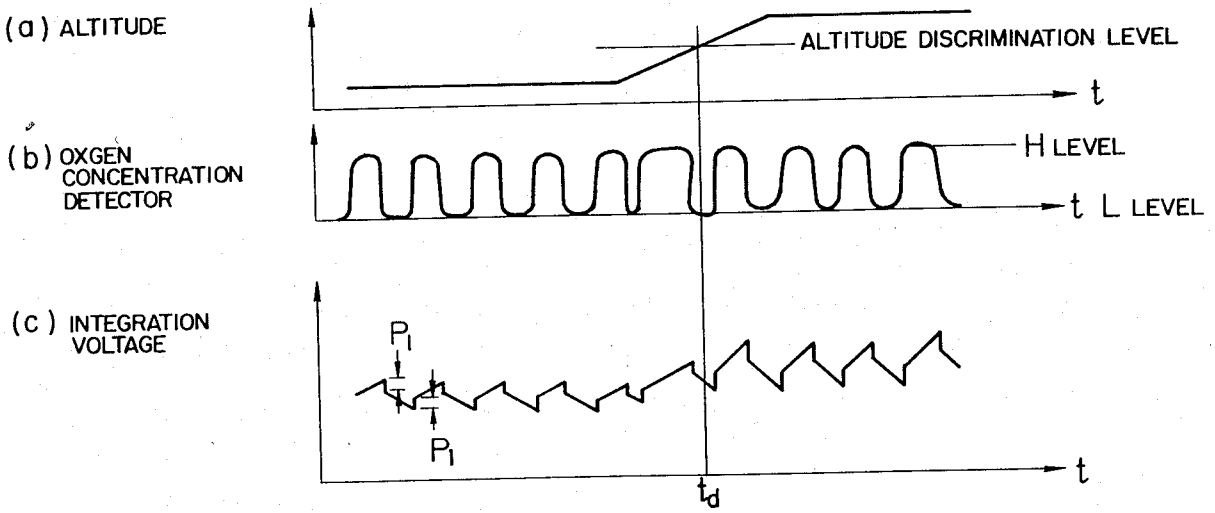
FIG. 3 is a time chart useful for explaining the operation of the apparatus according to the invention.

FIG. 2 is a circuit diagram for the embodiment of this invention, and FIG. 3 is a time chart for the circuitry of FIG. 2. The operation of the apparatus will now be described.

In the air-fuel ratio comparison circuit 6, the preset value corresponding to the stoichiometric air-fuel ratio is applied as a divided voltage of resistors 62 and 63 to the non-inverting input terminal of a comparator 61 and the output signal from the oxygen concentration detector 5 is applied to the inverting input terminal to compare it with the divided voltage and thereby generate a difference output. The output of the air-fuel ratio comparison circuit 6 goes to a "L" level when the air-fuel ratio of the exhaust gas is rich thus causing the output of the oxygen concentration detector 5 to go to a "H" level ((b) of FIG. 3), and the output of the air-fuel ratio comparison circuit 6 goes to the "H" level when the exhaust gas air-fuel ratio is lean thus causing the output of the oxygen concentration detector 5 to go to the "L" level ((b) of FIG. 3). The integrating circuit 7 receives the output of the air-fuel ratio comparison circuit 6 so that when the exhaust gas air-fuel ratio is rich causing the output of the air-fuel ratio comparison circuit 6 to go to the "L" level, a capacitor 72 is charged through a resistor 71 and the output of the integrating circuit 7 is increased. When this occurs, the actuator driver circuit 8 supplies a current corresponding to the integration voltage to the actuator 3 so that the actuator 3 is operated in a direction to open and the amount of bleed air is increased thereby changing the controlled air-fuel ratio leaner.

When the exhaust gas air-fuel ratio is lean so that the output of the comparator 61 goes to the "H" level, the capacitor 72 is charged in the opposite direction through the resistor 71 and the output of the integrating circuit 7 is decreased. Resistors 73 and 74 apply a reference voltage to an operational amplifier 75 and the reference voltage is varied through an inverter 76 and a resistor 77 in accordance with the state of the output level of the air-fuel ratio comparison circuit 6 thus providing a skip $P_1$ shown in (C) of FIG. 3.

Then, when the engine comes into a high altitude operation from a low altitude operation as shown at a time $t_d$ in FIG. 3 ((a) of FIG. 3), the divided voltage of the pressure sensor 9 is increased so that the output of a comparator 103 exceeds the voltage established by resistors 101 and 102 of the altitude comparison circuit 10 in correspondence to the predetermined altitude and it goes to the "L" level thereby causing the output of an inverter 111 of the integration constant control circuit 11 to go to the "H" level. Numerals 112 and 113 designate analog switches and their control terminals go to the "H" level. Thus, the analog switches 112 and 113 are turned on and resistors 114 and 115 are connected in parallel with the resistors 71 and 77, respectively, thus increasing the slope and skip of the integration voltage and thereby increasing the control response characteristic.

In accordance with an air-fuel ratio control apparatus provided according to the invention, due to the provision of a pressure sensor for sensing the atmospheric pressure, an altitude comparison circuit for comparing the sensor output with a preset value established in correspondence to a predetermined altitude and an integration constant control circuit responsive to the comparison output to generate a control signal for controlling the slope and skip of an integration voltage from an integrating circuit, there is an advantage that the air-fuel ratio control response characteristic can be improved upon transition from a low altitude running to a high altitude running.

We claim:

1. In an air-fuel ratio control apparatus including an oxygen concentration detecting circuit for detecting the concentration of oxygen in an exhaust gas from an engine of a vehicle and comparing a detection signal with a predetermined value preset in correspondence to a predetermined air-fuel ratio to generate a first difference signal, an integrating circuit responsive to said first difference signal to generate an integration signal and an air-fuel ratio control circuit responsive to said integration signal to generate a control signal for energizing air-fuel ratio control means, the improvement comprising:

an altitude detecting circuit for detecting an atmospheric pressure outside said vehicle and comparing a detection signal with a preset value set in correspondence to a predetermined altitude to generate a second difference signal; and an integration control circuit responsive to said second difference signal to control a circuit constant of said integrating circuit.

* * * * *